US010829927B2

(12) United States Patent
Houston et al.

(10) Patent No.: US 10,829,927 B2
(45) Date of Patent: Nov. 10, 2020

(54) VERTICAL SLIP FORM CONSTRUCTION SYSTEM WITH MULTI-FUNCTION PLATFORM, AND METHOD OF CONSTRUCTING A BUILDING THEREWITH

(71) Applicant: BIG TIME INVESTMENT, LLC, Southfield, MI (US)

(72) Inventors: Stephen T. Houston, Lake Orion, MI (US); Brian K. Threet, Plymouth, MI (US)

(73) Assignee: BIG TIME INVESTMENT, LLC, Southfield, MI (US)

( * ) Notice: Subject to any disclaimer, the term of this patent is extended or adjusted under 35 U.S.C. 154(b) by 38 days.

(21) Appl. No.: 16/296,966

(22) Filed: Mar. 8, 2019

(65) Prior Publication Data

US 2020/0284026 A1 Sep. 10, 2020

(51) Int. Cl.
*E02D 35/00* (2006.01)
*E04B 1/35* (2006.01)
*E04B 1/16* (2006.01)

(52) U.S. Cl.
CPC ..... *E04B 1/3516* (2013.01); *E04B 1/16* (2013.01); *E04B 1/3544* (2013.01); *E04B 2103/02* (2013.01)

(58) Field of Classification Search
CPC ..... E04B 1/00; E04B 2001/4192; E04B 1/19; E04B 1/3516; E04B 1/35; E04B 1/16; E04B 1/20; E04G 11/22; E04G 11/24; E02D 27/12; E02D 27/00
USPC ..... 52/79.11, 745.2, 79.14, 236.5, 236.6, 52/741.14, 344, 234, 272, 264, 249, 263
See application file for complete search history.

(56) References Cited

U.S. PATENT DOCUMENTS 3,283,465 A 11/1966 Cheskin
3,510,098 A * 5/1970 Fox ..... E04G 11/22 249/20
3,902,287 A * 9/1975 Livingston ..... E04B 1/34869 52/73
3,978,630 A 9/1976 Labie et al.
(Continued)

FOREIGN PATENT DOCUMENTS

KR 101407780 B1 6/2014
WO 2009079699 A1 7/2009

OTHER PUBLICATIONS

International search report for international application No. PCT/US20/21459.

*Primary Examiner* — Chi Q Nguyen
(74) *Attorney, Agent, or Firm* — Quinn IP Law

(57) ABSTRACT

A method of constructing a building includes attaching a first portion of a roof structure to the yokes of a vertical slip form system. A derrick crane is positioned on top of the first portion of the roof structure. A vertical support core of the building is then formed with the vertical slip form system. The first portion of the roof structure and the derrick crane are raised with the vertical slip form system. The vertical slip form system is removed from the formed vertical support core of the building, and the first portion of the roof structure is then moved into a final position and attached to the vertical support core. The remainder of the roof structure and subsequent floor plates may then be constructed at ground elevation, raised into place, and attached to the vertical support core in a top-down, descending order.

20 Claims, 5 Drawing Sheets

(56) References Cited

U.S. PATENT DOCUMENTS

| | | | | |
|---|---|---|---|---|
| 3,981,109 | A * | 9/1976 | Termohlen | E04B 1/3404 52/125.1 |
| 4,071,988 | A * | 2/1978 | Bowes | E04B 1/3511 52/127.1 |
| 5,198,235 | A * | 3/1993 | Reichstein | B28B 5/00 249/115 |
| 7,641,461 | B2 * | 1/2010 | Khoshnevis | B28B 1/001 425/60 |
| 7,784,231 | B2 | 8/2010 | Termohlen | |
| 8,281,546 | B2 * | 10/2012 | Thompson | E04G 11/22 52/745.17 |
| 9,752,316 | B2 * | 9/2017 | Thornton | E04B 1/4114 |
| 2003/0033772 | A1 | 2/2003 | Russell | |
| 2004/0045253 | A1 * | 3/2004 | Russell | E01D 21/08 52/745.11 |
| 2008/0276550 | A1 | 11/2008 | Termohlen | |
| 2009/0049762 | A1 | 2/2009 | Termohlen | |
| 2010/0281819 | A1 | 11/2010 | Thompson | |
| 2013/0067832 | A1 * | 3/2013 | Collins | E04B 1/343 52/125.1 |
| 2017/0089062 | A1 * | 3/2017 | Thornton | E04B 1/24 |
| 2018/0347211 | A1 * | 12/2018 | Zitting | E04G 21/16 |

* cited by examiner

VERTICAL SLIP FORM CONSTRUCTION SYSTEM WITH MULTI-FUNCTION PLATFORM, AND METHOD OF CONSTRUCTING A BUILDING THEREWITH

TECHNICAL FIELD

The disclosure generally relates to a method of constructing a building, and a vertical slip form construction system therefor.

BACKGROUND

Many methods of constructing multi-story buildings exist. Traditionally, multi-story buildings have been constructed from the ground up, in which construction of the building begins on a ground level by attaching higher elevation structural elements on top of previously assembled lower structural elements to construct the building in upward direction, i.e., from bottom up. This construction method requires that the structural elements be lifted by a crane and connected in situ at elevation. This is particularly timely and costly when constructing tall buildings.

A more recent construction method includes constructing a vertical support core of the building. The vertical support core is designed to carry all structural loads of the building. The floor plates, including the roof structure surrounding a vertical support core, are constructed around the base of the vertical support core at ground level, lifted vertically into place with strand jacks located on top of the vertical support core, and then connected to the vertical support core. In this matter, the roof structure surrounding the vertical support core is assembled at ground level, lifted to its final elevation, and then attached to the vertical support core. After the roof structure is attached to the vertical support core, the top floor plate is assembled at ground level, lifted to its final elevation, and then attached to the vertical support core. Subsequent floor plates are assembled and attached to the vertical support core in the same manner in a descending order. By so doing, the roof and the floor plates of the building are constructed in a downward direction, i.e., from top down.

SUMMARY

A method of constructing a building is provided. The method includes providing a vertical slip form system. The vertical slip form system includes a plurality of vertical form panels for forming a wall of a vertical support core of the building therebetween, and a plurality of yokes attached to the plurality of vertical form panels. A first portion of a roof structure is attached to the plurality of yokes. The first portion of the roof structure is a finished load bearing support system to be positioned over the vertical support core of the building. The vertical support core of the building is then formed from a hardenable material, such as but not limited to a concrete mixture, with the vertical slip form system. The vertical slip form system moves vertically upward from a ground elevation to a finished elevation while forming the vertical support core. The first portion of the roof structure is raised with the vertical slip form system while forming the vertical support core. The first portion of the roof structure is then detached from the plurality of yokes after the vertical support core is formed to the finished elevation. The vertical slip form system is removed from the formed vertical support core of the building, and the first portion of the roof structure is lowered onto the vertical support core and into a final position of the first portion of the roof structure. By so doing, the first portion of the roof structure does not have to be constructed in situ on top of the vertical support core. Rather, because the first portion of the roof structure is attached to the vertical slip form system at ground level, the vertical slip form system raises the first portion of the roof structure while concurrently forming the walls of the vertical support core of the building.

In one aspect of the method of constructing the building, a second portion of the roof structure is assembled at the ground elevation. The second portion of the roof structure is a finished load bearing support system to be positioned beyond the peripheral limits of the vertical support core. The second portion of the roof structure is then lifted vertically relative to the vertical support core into a final position of the second portion of the roof structure. The second portion of the roof structure is then attached to the vertical support core.

In another aspect of the method of constructing the building, a derrick crane is positioned on top of the first portion of the roof structure prior to forming the vertical support core. The first portion of the roof structure supports the derrick crane and transfers a vertical load from the derrick crane to the vertical slip form system. The derrick crane may include for example, but is not limited to, a crane having an eight ton lifting capacity and a nominal boom length equal to approximately eighty feet. The vertical slip form system includes a plurality of form jacks. Each of the form jacks is attached to one of the yokes. The form jacks climb a jack rod to move the vertical slip form system upward while forming the walls of the vertical support core. The form jacks are sized to include a combined lifting capacity capable of lifting the vertical slip form system, the first portion of the roof structure, and the derrick crane. The derrick crane may be used to raise and lower construction equipment, materials, and supplies onto and off of the first portion of the roof structure, as well as other elevations of the building, while the vertical slip form system is forming the walls of the vertical support core, and after the vertical support core is formed. This eliminates the need for a tower mounted jib crane next to the building. Additionally, by placing the derrick crane on top of the first portion of the roof structure prior to forming the vertical support core, the derrick crane may be used to assist formation of the vertical support core with the vertical slip form system. Once the vertical support core is formed and the first portion of the roof structure is positioned on top of the vertical support core, the derrick crane may be used for other construction purposes.

A construction system for constructing a building is also provided. The construction system includes a vertical slip form system operable to form a vertical support core of the building from a hardenable material, while moving vertically upward from a ground elevation to a finished elevation. The slip form system includes a plurality of vertical form panels for forming a wall of the vertical support core therebetween, and a plurality of yokes attached to the plurality of vertical form panels. A first portion of a roof structure is temporarily attached to the plurality of yokes. The first portion of the roof structure is a finished load bearing support system to be positioned over the vertical support core of the building. A derrick crane is positioned on top of and supported by the first portion of the roof structure. The slip form system includes a plurality of form jacks having a combined lifting capacity capable of lifting the slip form system, the first portion of the roof structure, and the derrick crane.

A multi-story building disposed on a ground elevation is also provided, and includes a vertical support core, a roof structure and a plurality of floors. The vertical support core includes a vertical slip form system, wherein the vertical form panels form a wall of the vertical support core. The roof structure includes a first portion and a second portion, wherein the first portion of the roof structure is a finished load bearing support system that is positioned over the vertical support core, and wherein the second portion of the roof structure is a finished load bearing support system that is positioned beyond peripheral limits of the vertical support core, wherein the second portion is assembled at the ground elevation, and wherein the second portion is lifted vertically relative to the vertical support core into a final position. The plurality of floor plates includes each of the floorplates corresponding to one of the stories of the building or the roof structure, wherein each of the floorplates is assembled at the ground elevation, lifted to a final elevation, and attached to the vertical support core in a descending order.

The above features and advantages and other features and advantages of the present teachings are readily apparent from the following detailed description of the best modes for carrying out the teachings when taken in connection with the accompanying drawings.

DETAILED DESCRIPTION

Those having ordinary skill in the art will recognize that terms such as "above," "below," "upward," "downward," "top," "bottom," etc., are used descriptively for the figures, and do not represent limitations on the scope of the disclosure, as defined by the appended claims.

Figure 1:
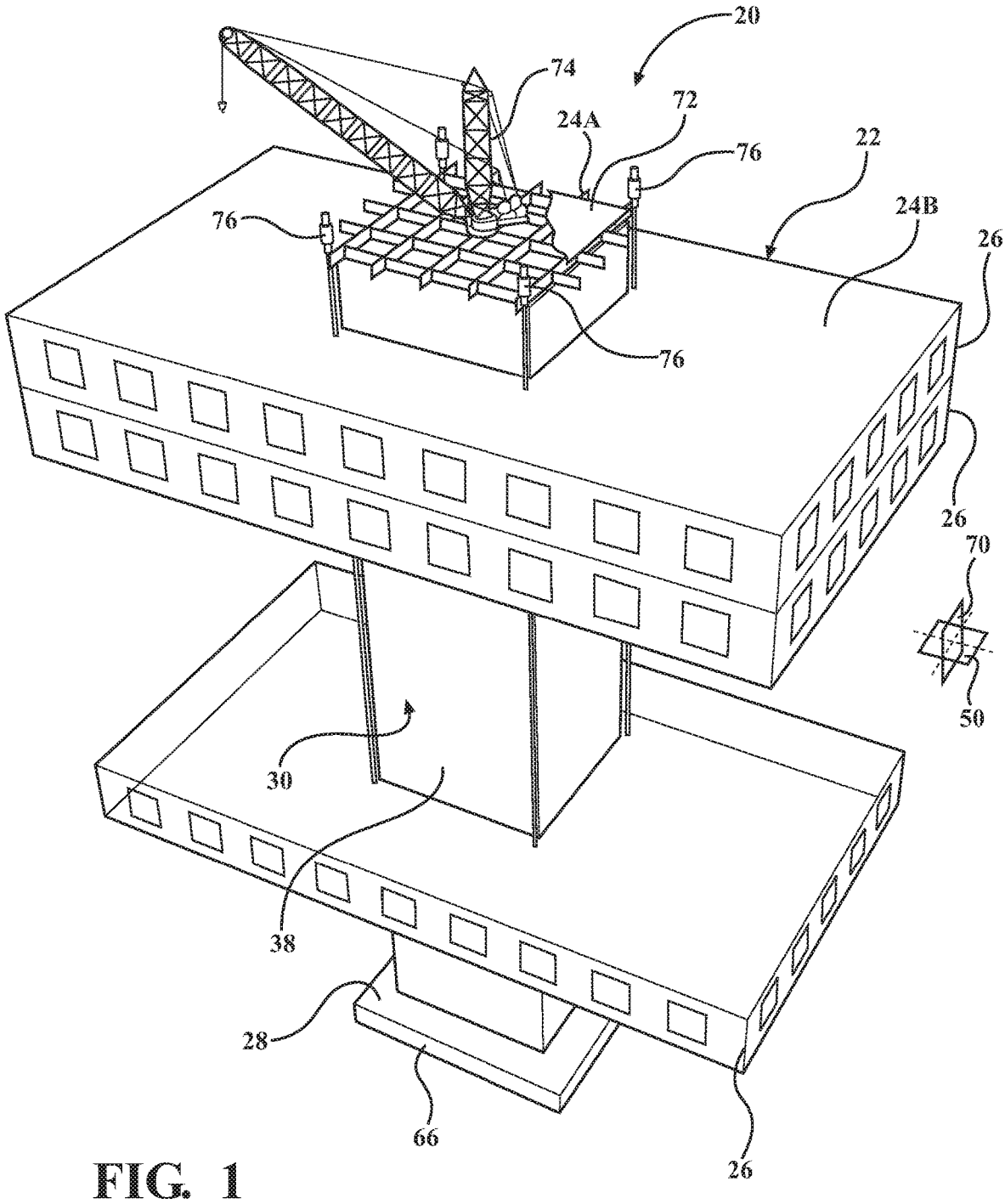
FIG. 1 is a schematic perspective view of a partially constructed building.

Referring to the Figures, wherein like numerals indicate like parts throughout the several views, a construction system is generally shown at 20 in FIG. 1. Referring to FIG. 1, the construction system 20 may be used in the construction of a building 22, and particularly a multi-story building 22. In general, the construction system 20 may be used to implement a top-down construction process, in which floor plates 26 are constructed at ground elevation 28, lifted to a respective final elevation, and attached to a vertical support core 30 of the building 22 in a descending, sequential order.

As used herein, the term "floor plate 26" may include all structural or frame members, e.g., joists and/or purlins, flooring, e.g., concrete floor, interior walls, exterior curtain walls, modular room subassemblies, e.g., a lavatory module, utilities, etc., that form a floor or level of the building 22. The term "floor plate 26" may include a plate for the roof structure 24A, 24B of the building 22, as well as a plate for a floor or level of the building 22. Accordingly, it should be appreciated that the term "floor plate 26" is used herein to refer to both the roof structure 24A, 24B for the roof of the building 22, as well as a floor structure for a floor or level of the building 22. As used herein and shown in the Figures, the reference numeral 26 may refer and indicate any floor plate 26 of the building 22, whereas the reference numeral 24A refers to and indicates a first portion of the roof structure, and the reference numeral 24B refers to and indicates a second portion of the roof structure.

Figure 2:
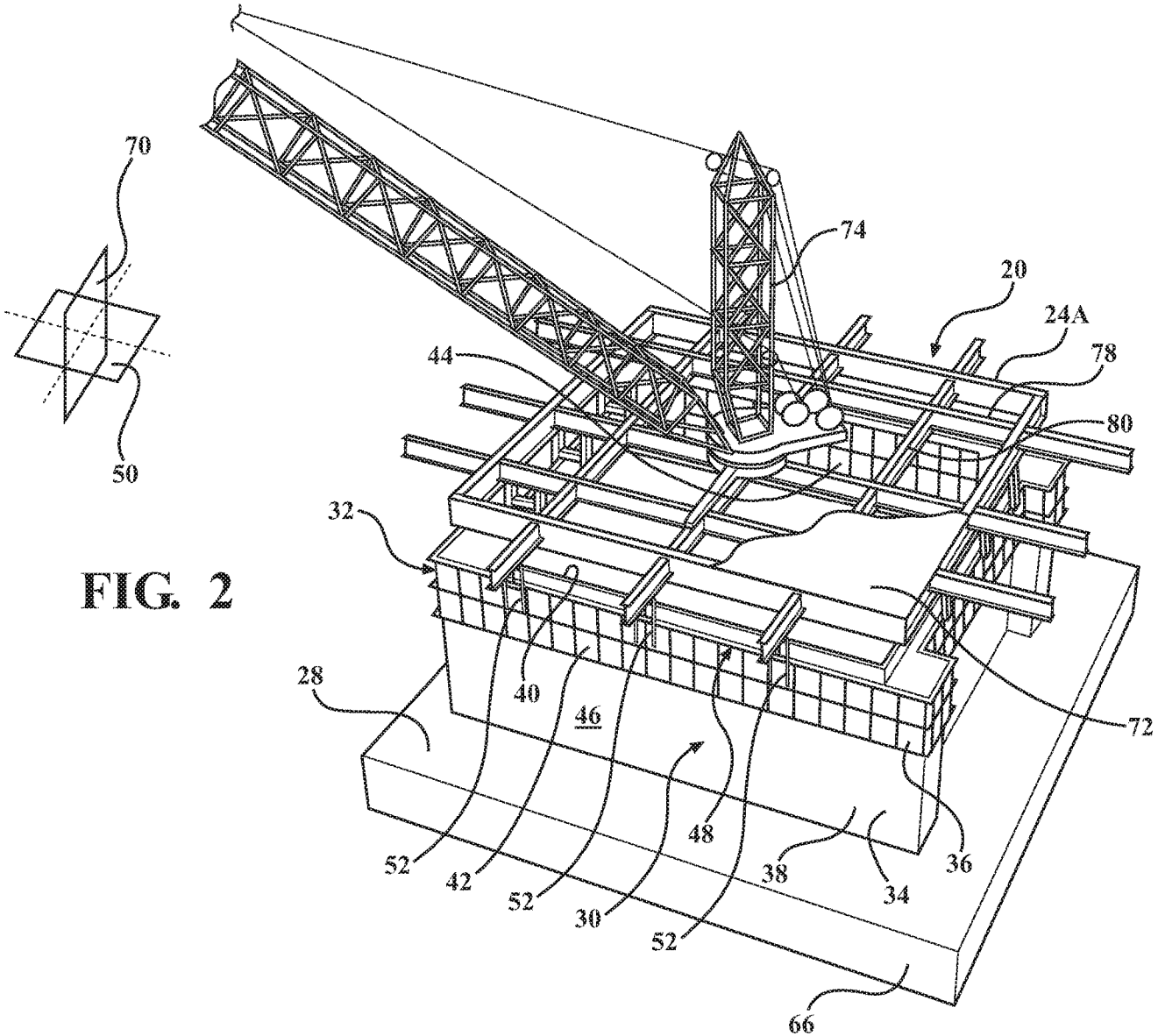
FIG. 2 is a schematic perspective view of the partially constructed building showing a vertical slip form system forming a vertical support core of the building.

Referring to FIG. 2, the construction system 20 includes a vertical slip form system 32. The vertical slip form system 32 is operable to form the vertical support core 30 of the building 22 from a hardenable material 34, while moving vertically upward from the ground elevation 28 to a finished elevation. The hardenable material 34 may include, but is not limited to, a concrete mixture or other similar composition. The hardenable material 34 may include one or more additives to enhance one or more physical characteristics of the hardenable mixture, such as to reduce curing time, reduce slump, increase strength, etc. The specific type and contents of the hardenable mixture may be dependent upon the specific application of the building 22, and may be dependent upon the specific geographic region in which the building 22 is being constructed. The specific type and contents of the hardenable mixture are understood by those skilled in the art, are not pertinent to the teachings of this disclosure, and are therefore not described in greater detail herein.

Figure 3:
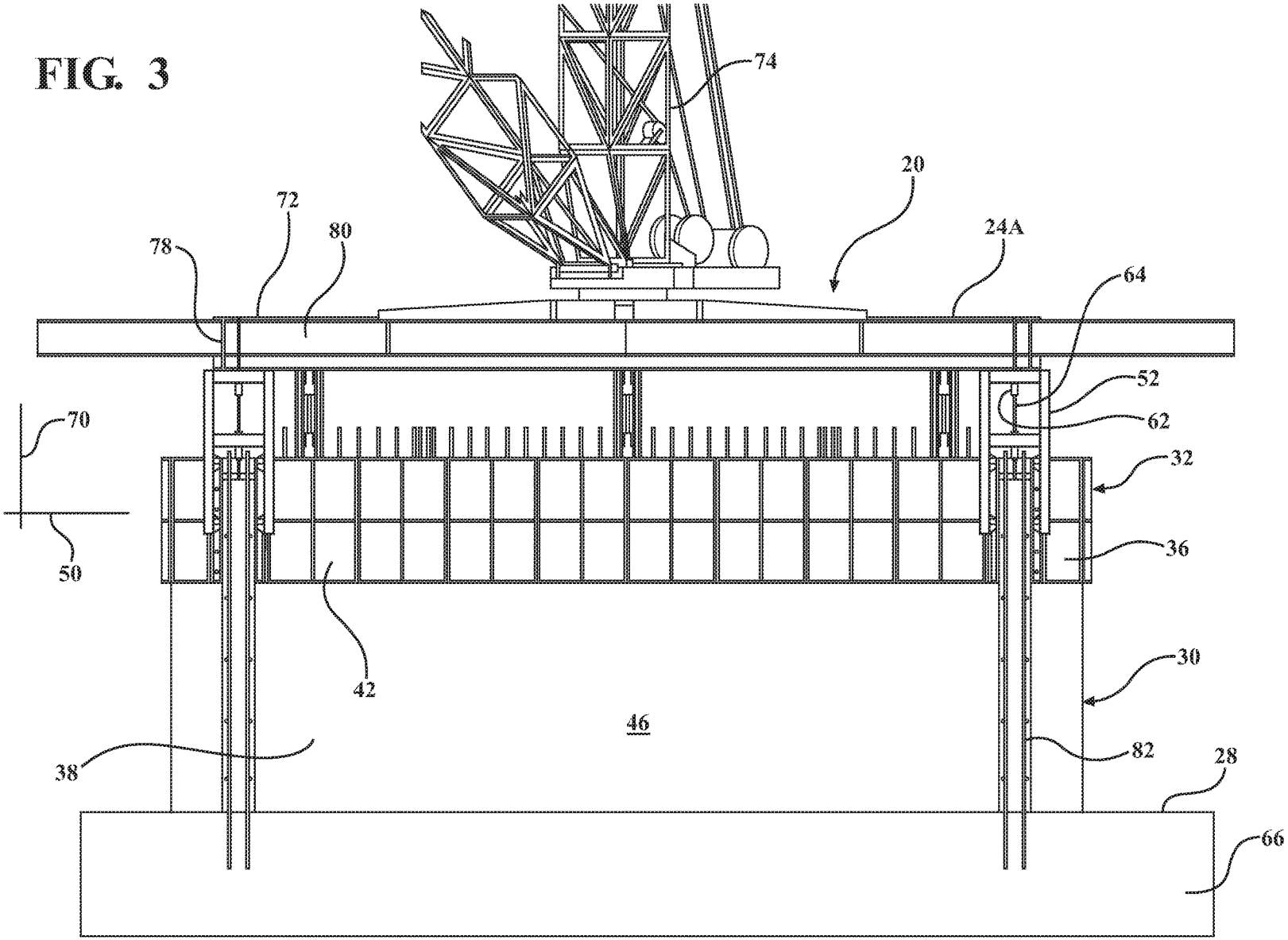
FIG. 3 is a schematic cross sectional view of the vertical slip form system and the vertical support core of the building.

Referring to FIG. 3, the vertical slip form system 32 includes a plurality of form panels 36 for forming a wall 38 of the vertical support core 30 therebetween. The form panels 36 are arranged to include inner panels 40 for forming an interior surface 44 of the wall 38 of the vertical support core 30, and outer panels 42 for forming an exterior surface 46 of the wall 38 of the vertical support core 30. The inner panels 40 and the outer panels 42 are spaced apart from each other to define a thickness 48 of the wall 38 therebetween. As shown in the exemplary embodiment of FIG. 2, the form panels 36 are arranged to form the wall 38 to include a generally rectangular cross section on a horizontal plane 50. However, it should be appreciated that the form panels 36 may be arranged differently than shown in the exemplary embodiment. The vertical support core 30 is designed to carry the vertical loads the building 22. As such, the shape of the vertical support core 30 may be designed as necessary to provide the required compressive strength, shear strength, and bending strength for the particular application, size, and location of the building 22. It should be appreciated that the wall 38 of the vertical support core 30 may be configured to include multiple load bearing columns connected by shear walls. In other embodiments, the wall 38 of the vertical support core 30 may be designed to include a generally uniform construction around the entire perimeter of the vertical support core 30. Regardless of the cross sectional shape of the wall 38 on the horizontal plane 50, the form panels 36 are positioned to define the cross sectional shape of the vertical support core 30, relative to the horizontal plane 50. It should be appreciated that the cross sectional shape of the wall 38 of the vertical support core 30 remains consistent throughout the height of the building 22.

The vertical slip form system 32 further includes a plurality of yokes 52. The yokes 52 are attached to the vertical form panels 36. The yokes 52 may be attached to the form panels 36 in any suitable manner, such as but not limited to, a plurality of fasteners or connectors. Adjacent pairs of yokes 52 may include one or more walers extending therebetween to provide lateral support to the form panels 36. As shown, each of the yokes 52 includes a pair of vertical yoke columns, with one of the yoke columns extending vertically and attached to an inner panel 40, and the other of the yoke columns extending vertically and attached to an outer panel 42. Each of the yokes 52 includes a lower horizontal yoke beam and an upper horizontal yoke beam, each extending between and connecting the yoke columns of their respective yoke 52. The yokes 52 shown in the Figures and described herein are exemplary embodiments. It should be appreciated that the specific construction of the yokes 52 may vary from the exemplary embodiment shown and described herein.

The vertical slip form system 32 includes a plurality of form jacks 62. In one embodiment, each of the yokes 52 includes a respective form jack 62. However, in other embodiments, each of the yokes 52 need not include a respective form jack 62. The form jack 62 is operable to lift the vertical slip form system 32 vertically upward relative to the wall 38 of the vertical support core 30, as shown with reference to FIG. 4. In the exemplary embodiment shown in FIG. 3 and described herein, the form jacks 62 engage a jack rod 64. The jack rod 64 is positioned vertically, between the form panels 36. The form jacks 62 grasp and move relative to the jack rod 64, with the jack rod 64 transferring the vertical load from the form jacks 62 to a foundation 66 and/or portions of the wall 38 of the vertical support core 30 previously formed.

A first portion of the roof structure 24A is temporarily attached to an upper end of the yokes 52. The first portion of the roof structure 24A may be attached to the yokes 52 in any suitable manner, such as but not limited to, a plurality of fasteners, connectors, temporary locking brackets, etc. The first portion of the roof structure 24A is rigidly attached to the yokes 52 to brace the yokes 52 and maintain a position of the yokes 52 and the form panels 36 relative to each other, and relative to a vertical plane 70 and the horizontal plane 50 of the building 22. By so doing, the accuracy of the vertical slip form system 32 is increased because the relative position of the form panels 36 and the yokes 52 is maintained by the rigidity of the first portion of the roof structure 24A.

The first portion of the roof structure 24A is a finished load bearing support system of the final roof structure that is to be positioned over the vertical support core 30 of the building 22. The first portion of the roof structure 24A may be constructed from multiple steel beams attached together in a system of rafters 78 and purlins 80 as known in the art. However, the first portion of the roof structure 24A may be constructed in other manners using other materials, such as with a series of trusses or pre-fabricated concrete beams, etc. A temporary floor 72 may be disposed on top of the first portion of the roof structure 24A to provide a walking surface for construction workers, as well as a staging area for construction materials.

The construction system 20 further includes a derrick crane 74 that is positioned on top of and supported by the first portion of the roof structure 24A. The derrick crane 74 may be sized for the specific building 22. However, an exemplary embodiment of the derrick crane 74 includes an eight ton lifting capacity having a nominal boom length equal to eighty feet. The derrick crane 74 may be rigidly attached to the first portion of the roof structure 24A. The features and operation of the derrick crane 74 are well known to those skilled in the art, are not pertinent to the teachings of this disclosure, and are therefore not described in detail herein.

Because the derrick crane 74 is attached to and supported by the first portion of the roof structure 24A, and the first portion of the roof structure 24A is attached to and supported by the yokes 52 of the vertical slip form system 32, the form jacks 62 of the vertical slip form system 32 are sized to include a combined lifting capacity capable of lifting the vertical slip form system 32, the first portion of the roof structure 24A, and the derrick crane 74, relative to the wall 38 of the vertical support core 30.

As shown in FIG. 1, the construction system 20 may further include at least one lifting device 76 attached to the first portion of the roof structure 24A. The lifting devices 76 may be used for raising the second portion of the roof structure 24B and the floor plates 26 relative to the vertical support core 30. For example, the lifting devices 76 may include, but are not limited to, a plurality of strand jacks. However, the lifting devices 76 may include other devices capable of lifting the second portion of the roof structure 24B and the floor plates 26 of the building 22. The strand jacks grasp and move a cable to lift heavy objects. The specific features and operation of the strand jacks are known to those skilled in the art, are not pertinent to the teachings of this disclosure, and are therefore not described herein.

A method of constructing a building 22 is also provided. The method includes providing the vertical slip form system 32. Referring to FIG. 3 and as described above, the vertical slip form system 32 includes the plurality of vertical form panels 36 for forming the wall 38 of the vertical support core 30 therebetween, and the plurality of yokes 52 attached to the vertical form panels 36. Additionally, the vertical slip form system 32 includes the form jacks 62 that move the vertical slip form system 32 vertically as the wall 38 of the vertical support core 30 is formed. The vertical slip form system 32 is placed on the foundation 66 of the building 22. The foundation 66 may include a mat foundation 66, and may optionally include pilings supporting the mat foundation 66. The specific design and construction of the foundation 66 is dependent upon the soil conditions and the loading requirements of the building 22. The foundation 66 supports the vertical support core 30, and transfers the loading from the vertical support core 30 to the ground. The specific construction of the foundation 66 will vary for each building 22 and site requirements, is not pertinent to the teachings of this disclosure, and is therefore not described in detail herein.

The first portion of the roof structure 24A is then attached atop the yokes 52 of the vertical slip form system 32. As described above, the first portion of the roof structure 24A is the finished load bearing support system to be positioned over the vertical support core 30 of the building 22. As shown in FIG. 3, the first portion of the roof structure 24A may include, but is not limited to, a system of steel beam rafters 78 and purlins 80 attached together. However, the first portion of the roof structure 24A may be constructed from other construction materials. The first portion of the roof structure 24A is rigidly attached to the yokes 52 to provide support and bracing for the yokes 52 of the vertical slip form system 32, as well as to provide a work surface.

The derrick crane 74 may then be placed atop of the first portion of the roof structure 24A. Notably, the derrick crane 74 is positioned atop the first portion of the roof structure 24A prior to forming the wall 38 of the vertical support core 30. As described above, the first portion of the roof structure 24A supports the derrick crane 74 and transfers the vertical load from the derrick crane 74 to the vertical slip form system 32. As such, the first portion of the roof structure 24A provides a platform having sufficient strength to support the derrick crane 74 and any load hoisted by the derrick crane 74.

Once the derrick crane 74 is positioned atop the first portion of the roof structure 24A of the wall 38 structure, the wall 38 of the vertical support core 30 of the building 22 may be formed from the hardenable material 34, e.g., concrete, with the vertical slip form system 32. As understood by those skilled in the art, the vertical slip form system 32 moves vertically upward from the ground elevation 28 to the finished elevation of the wall 38 while forming the wall 38 of the vertical support core 30. Because the first portion of the roof structure 24A and the derrick crane 74 are supported by and attached to the vertical slip form system 32, the first portion of the roof structure 24A and the derrick crane 74 are simultaneously raised with the vertical slip form system 32 while forming the wall 38 of the vertical support core 30.

The process of forming the wall 38 of the vertical support core 30 using the vertical slip form system 32 is understood by those skilled in the art, and is therefore not described in detail herein. However, referring to FIG. 2, the process of forming the wall 38 with the vertical slip form system 32 is generally described. The process of forming the wall 38 of the vertical support core 30 with the vertical slip form system 32 includes positioning reinforcing elements 82 of the wall 38, along with any opening supports and/or framing, between the inner panels 40 and the outer panels 42 of the vertical slip form system 32. The hardenable material 34, e.g., concrete, is poured and/or pumped into the cavity between the inner panels 40 and the outer panels 42. As the hardenable material 34 cures, the form jacks 62 raise the vertical slip form system 32 vertically upward along the jack rods 64, exposing a portion of the wall 38 below the form panels 36. The vertical slip form system 32 moves slowly but continuously upward as the hardenable material 34 is poured into the cavity between the inner panels 40 and the outer panels 42. The process continues and non-stop until the full height of the wall 38 of the vertical support core 30 has been formed. It should be appreciated that the derrick crane 74 positioned atop the first portion of the roof structure 24A may be used throughout the forming process of the wall 38 of the vertical support core 30 to raise and lower materials, supplies and equipment necessary for the forming process. Accordingly, it is not necessary to have a tower mounted jib crane positioned next to the building 22 site to raise and lower materials, supplies and equipment. Because the derrick crane 74 is much less costly to purchase, maintain, and operate than a tower mounted jib crane, the construction costs for the building 22 are reduced by placing the derrick crane 74 on top of the vertical slip form system 32, so that it moves with the vertical slip form system 32 as the wall 38 of the vertical support core 30 is formed upward.

Figure 4:
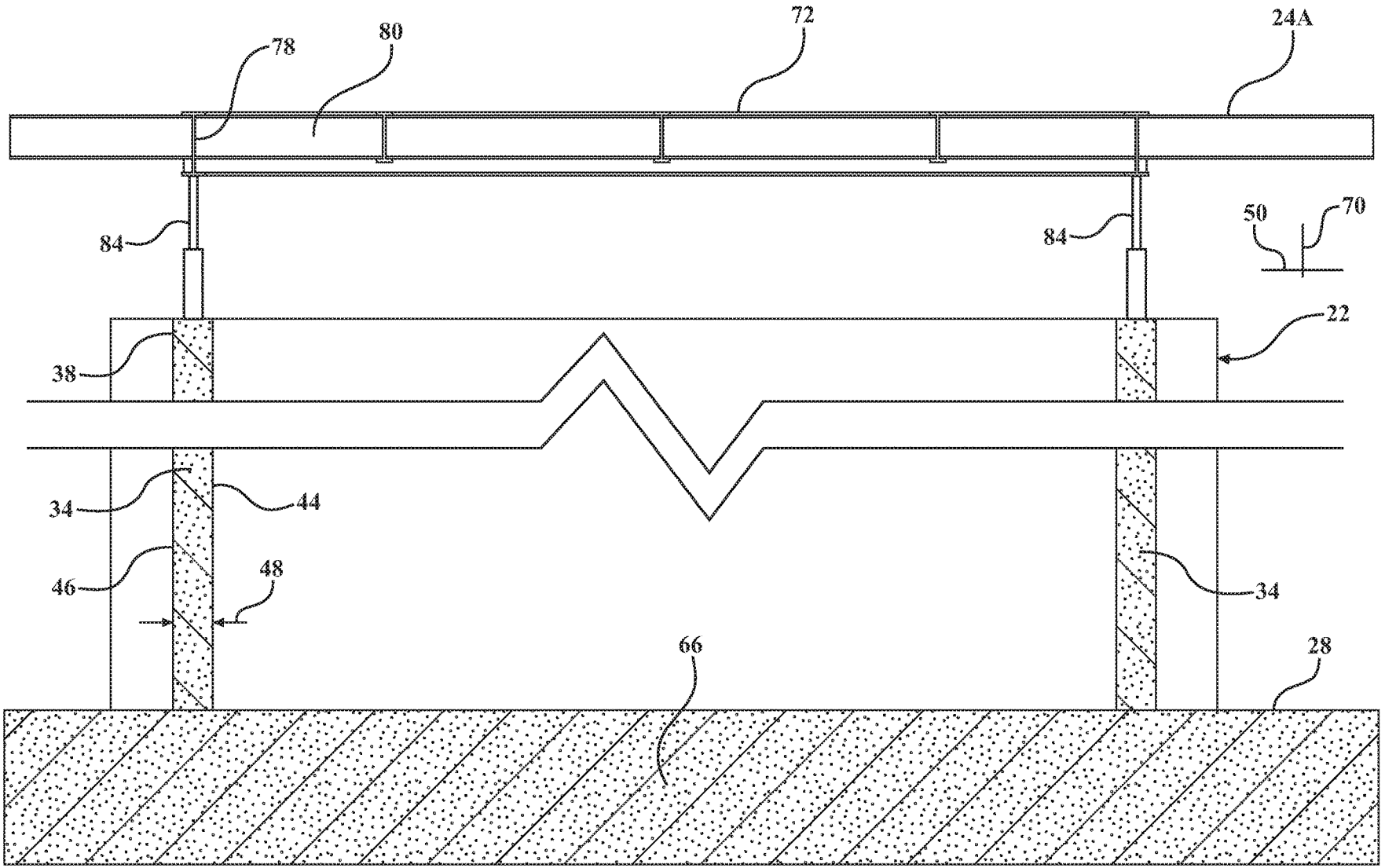
FIG. 4 is a schematic cross sectional view of the building showing a first portion of the roof structure detached and raised from the vertical slip form system.

Referring to FIGS. 3 and 4, once the vertical support core 30 has been formed to the finished elevation, the first portion of the roof structure 24A is detached from the plurality of yokes 52, and may be raised relative to the vertical slip form system 32. The first portion of the roof structure 24A may be raised relative to the vertical slip form system 32 and the vertical support core 30 in any suitable manner, such as but not limited to, placing hydraulic jacks 84 or other similar jacking devices between the top of the wall 38 of the vertical support core 30 and the first portion of the roof structure 24A, and then extending the length of the hydraulic jacks 84 to raise the first portion of the roof structure 24A relative to the wall 38 of the vertical support core 30. The vertical slip form system 32, including the yokes 52 and the panel forms, may then be disassembled and removed from the formed vertical support core 30 of the building 22. The distance that the first portion of the roof structure 24A is raised may be minimal, e.g., a few millimeters or even less, and may include only enough distance to allow removal of the yokes 52. In other embodiments, the first portion of the roof structure 24A may not need to be raised at all to remove the yokes 52.

Figure 5:
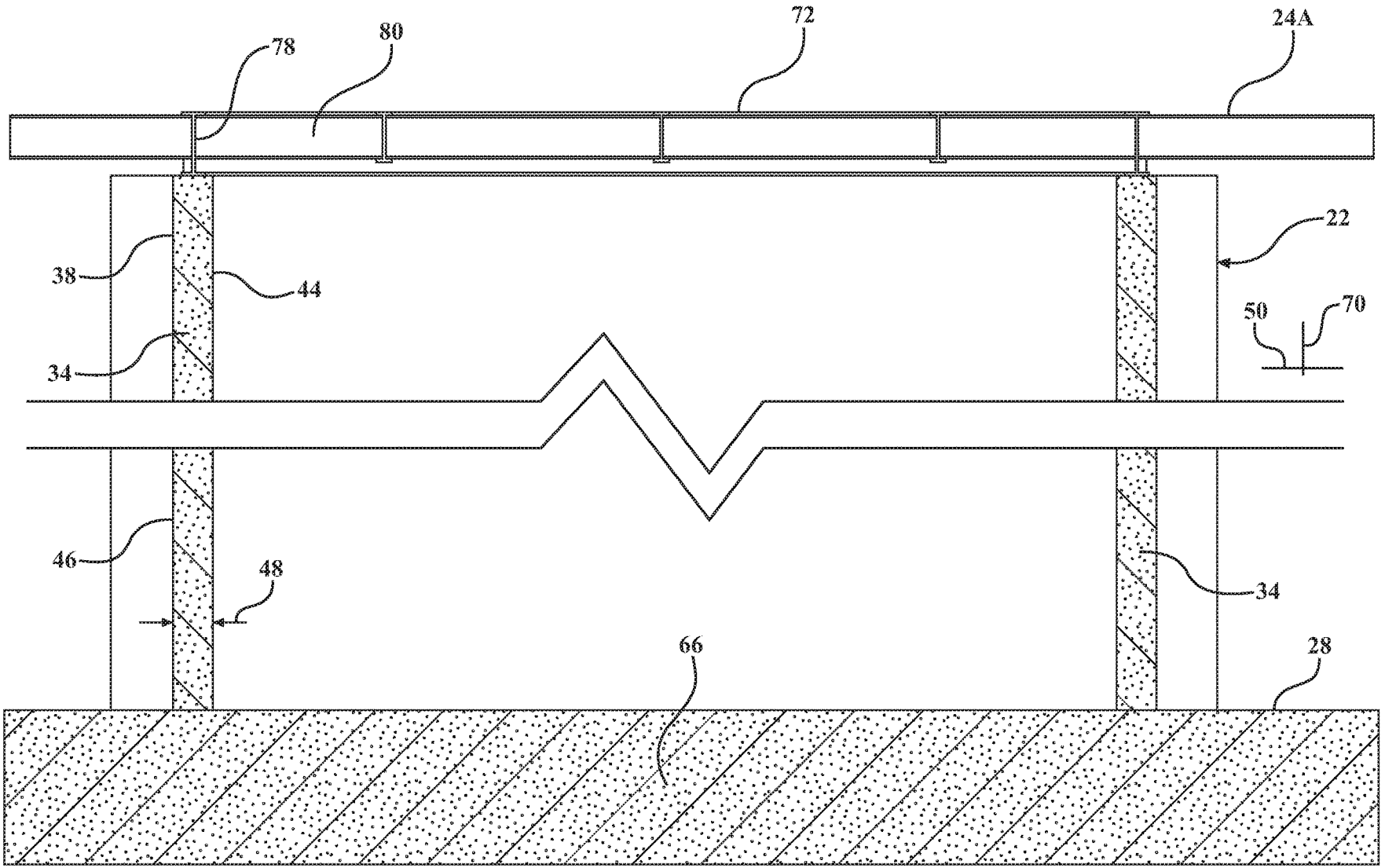
FIG. 5 is a schematic cross sectional view of the building showing the first portion of the roof structure positioned in a final position on top of the vertical support core of the building.

Referring to FIGS. 3 and 5, once the vertical slip form system 32 has been removed from the vertical support core 30 of the building 22, the first portion of the roof structure 24A may then be lowered onto the vertical support core 30 and into a final position or elevation of the first portion of the roof structure 24A. As described above, the first portion of the roof structure 24A is the final structure of the roof of the building 22. Accordingly, by attaching the first portion of the roof structure 24A on top of the vertical slip form system 32, the first portion of the roof structure 24A is able to provide the necessary support the enables the derrick crane 74 to be positioned thereon. Additionally, the first portion of the roof structure 24A is raised as the wall 38 of the vertical support core 30 is formed, so that the first portion of the roof structure 24A does not have to be lifted and/or assembled in place on top of the vertical support core 30 after the vertical support core 30 has been completed.

Once the first portion of the roof structure 24A is positioned atop the vertical support core 30 at its final position, the first portion of the roof structure 24A may be secured to the vertical support core 30 of the building 22. The first portion of the roof structure 24A may be secured to the vertical support core 30 in any suitable manner. The specific manner in which the first portion of the roof structure 24A is secured to the vertical support core 30 is dependent upon the specific design considerations of the building 22 and the location. The specific manner in which the first portion of the roof structure 24A is secured to the vertical support core 30 is well known to those skilled in the art, is not pertinent to the teachings of this disclosure, and is therefore not described in detail herein.

As shown in FIG. 1, at least one lifting device 76 may be positioned on top of the first portion of the roof structure 24A. As described above, the lifting devices 76 may include, but are not limited to, a strand jack or other similar device. The lifting devices 76 may be positioned on top of the first portion of the roof structure 24A either before the wall 38 of the vertical support core 30 is formed, or after the first portion of the roof structure 24A has been secured to the vertical core support of the building 22. The lifting devices 76 are operable to lift a second portion of the roof structure 24B, and subsequent floor plates 26 from the ground elevation 28 to their respective final elevations.

The second portion of the roof structure 24B may be assembled at the ground elevation 28. The second portion of the roof structure 24B is a finished load bearing support system to be positioned beyond the peripheral limits of the vertical support core 30. In other words, the second portion of the roof structure 24B constitutes the remainder of the roof structure not included in the first portion of the roof structure 24A, as shown with reference to FIG. 2. The second portion of the roof structure 24B may include, but is not limited to, a system of steel beam rafters 78 and purlins 80 attached together. However, the second portion of the roof structure 24B may be constructed from other construction materials. As is understood by those skilled in the art, the second portion of the roof structure 24B may be assembled at ground elevation 28 to include all support elements, roof plating, etc., as well as any mechanical equipment that is to be place on top of the second portion of the roof structure 24B.

Referring to FIG. 1, once the second portion of the roof structure 24B is assembled at ground elevation 28, the second portion of the roof structure 24B raised or lifted vertically relative to the vertical support core 30 into a final position for the second portion of the roof structure 24B. The second portion of the roof structure 24B may then be attached to the vertical support core 30. The second portion of the roof structure 24B may be attached to the vertical support core 30 in any suitable manner, such as but not limited to, using fasteners and/or connectors to secure the second portion of the roof structure 24B to the vertical support core 30. The manner in which the second portion of the roof structure 24B is attached to the first portion of the roof structure 24A and the vertical support core 30 is dependent upon several factors, such as the specific design of the building 22, geographic region of the building 22, etc., and are understood by those skilled in the art. Additionally, the specific details on how the second portion of the roof structure 24B is attached to the first portion of the roof structure 24A and the vertical support core 30 are not pertinent to the teachings of this disclosure, and are therefore not described in detail herein.

As shown in FIG. 1, once the second portion of the roof structure 24B is secured to the vertical support core 30 in its final position, the remaining floor plates 26 may be assembled at ground elevation 28 and lifted into their respective final elevations relative to the vertical support core 30 in a sequential descending order, as is understood by those skilled in the art.

The detailed description and the drawings or figures are supportive and descriptive of the disclosure, but the scope of the disclosure is defined solely by the claims. While some of the best modes and other embodiments for carrying out the claimed teachings have been described in detail, various alternative designs and embodiments exist for practicing the disclosure defined in the appended claims.

The invention claimed is:

1. A method of constructing a building, the method comprising:

providing a vertical slip form system having a plurality of vertical form panels for forming a wall therebetween, and a plurality of yokes attached to the plurality of vertical form panels;

attaching a first portion of a roof structure to the plurality of yokes, wherein the first portion of the roof structure is a finished load bearing support system to be positioned over a vertical support core of the building;

forming the vertical support core of the building from a hardenable material with the vertical slip form system, whereby the vertical slip form system moves vertically upward from a ground elevation to a finished elevation while forming the vertical support core, and whereby the first portion of the roof structure is raised with the vertical slip form system while forming the vertical support core;

detaching the first portion of the roof structure from the plurality of yokes after the vertical support core is formed to the finished elevation;

removing the vertical slip form system from the formed vertical support core of the building; and lowering the first portion of the roof structure onto the vertical support core and into a final position of the first portion of the roof structure.

2. The method set forth in claim 1, further comprising securing the first portion of the roof structure to the vertical support core of the building after the first portion of the roof structure has been lowered into the final position.

3. The method set forth in claim 1, further comprising positioning a derrick crane on top of the first portion of the roof structure prior to forming the vertical support core, whereby the first portion of the roof structure supports the derrick crane and transfers a vertical load from the derrick crane to the vertical slip form system.

4. The method set forth in claim 3, wherein the derrick crane includes an eight ton lifting capacity having a nominal boom length equal to eighty feet.

5. The method set forth in claim 3, wherein the vertical slip form system includes a plurality of form jacks having a combined lifting capacity capable of lifting the vertical slip form system, the first portion of the roof structure, and the derrick crane.

6. The method set forth in claim 1, further comprising raising the first portion of the roof structure relative to the vertical slip form system after detaching the first portion of the roof structure from the vertical slip form system.

7. The method set forth in claim 1, further comprising assembling a second portion of the roof structure at the ground elevation, wherein the second portion of the roof structure is a finished load bearing support system to be positioned beyond peripheral limits of the vertical support core.

8. The method set forth in claim 7, further comprising lifting the second portion of the roof structure vertically relative to the vertical support core into a final position of the second portion of the roof structure.

9. The method set forth in claim 8, further comprising attaching the second portion of the roof structure to vertical support core.

10. The method set forth in claim 7, further comprising positioning at least one lifting device on the first portion of the roof structure, wherein the at least one lifting device is operable to lift the second portion of the roof structure.

11. The method set forth in claim 10, wherein positioning the at least one lifting device on the first portion of the roof structure is further defined as positioning the at least one lifting device on the first portion of the roof structure after the first portion of the roof structure has been secured to the vertical core support of the building.

12. The method set forth in claim 10, wherein the at least one lifting device includes a strand jack.

13. A method of constructing a building, the method comprising:

providing a vertical slip form system having a plurality of vertical form panels for forming a wall of a vertical support core therebetween, and a plurality of yokes attached to the plurality of vertical form panels;

attaching a first portion of a roof structure to the plurality of yokes, wherein the first portion of the roof structure is a finished load bearing support system to be positioned over the vertical support core of the building;

positioning a derrick crane on top of the first portion of the roof structure, whereby the first portion of the roof structure supports the derrick crane and transfers a vertical load from the derrick crane to the vertical slip form system;

forming the vertical support core of the building from a hardenable material with the vertical slip form system, with the derrick crane supported on the first portion of the roof structure, whereby the vertical slip form system moves vertically upward from a ground elevation to a finished elevation while forming the vertical support core, and whereby the first portion of the roof structure and the derrick crane are raised with the vertical slip form system while forming the vertical support core;

detaching the first portion of the roof structure from the plurality of yokes after the vertical support core is formed to the finished elevation;

raising the first portion of the roof structure relative to the formed vertical support core of the building;

removing the vertical slip form system from the formed vertical support core of the building;

lowering the first portion of the roof structure onto the vertical support core and into a final position of the first portion of the roof structure;

securing the first portion of the roof structure to the vertical support core of the building after the first portion of the roof structure has been lowered into the final position;

assembling a second portion of the roof structure at the ground elevation, wherein the second portion of the roof structure is a finished load bearing support system to be positioned beyond peripheral limits of the vertical support core;

lifting the second portion of the roof structure vertically relative to the vertical support core into a final position of the second portion of the roof structure; and attaching the second portion of the roof structure to the vertical support core.

14. A construction system for constructing a building, the construction system comprising:

a slip form system operable to form a vertical support core of the building from a hardenable material while moving vertically upward from a ground elevation to a finished elevation;

wherein the slip form system includes a plurality of vertical form panels for forming a wall of the vertical support core therebetween, and a plurality of yokes attached to the plurality of vertical form panels;

a portion of a roof structure temporarily attached to the plurality of yokes, wherein the portion of the roof structure is a finished load bearing support system to be positioned over the vertical support core of the building;

a derrick crane positioned on top of and supported by the portion of the roof structure; and wherein the slip form system includes a plurality of form jacks having a combined lifting capacity capable of lifting the slip form system, the portion of the roof structure, and the derrick crane.

15. The construction system set forth in claim 14, wherein the portion of the roof structure is rigidly attached to the plurality of yokes to brace the plurality of yokes and maintain a position of the plurality of yokes and the plurality of form panels relative to each other and relative to a vertical plane and a horizontal plane.

16. The construction system set forth in claim 14, further comprising a temporary floor disposed on top of the portion of the roof structure to provide a walking surface for construction workers.

17. The construction system set forth in claim 14, further comprising at least one lifting device attached to the portion of the roof structure.

18. The construction system set forth in claim 17, wherein the at least one lifting device is a strand jack.

19. The construction system set forth in claim 14, wherein the derrick crane includes an eight ton lifting capacity having a nominal boom length equal to eighty feet.

20. A multi-story building disposed on a ground elevation, comprising:

a vertical support core including a vertical slip form system including a plurality of vertical form panels, wherein the vertical form panels form a wall of the vertical support core;

a roof structure including a first portion and a second portion, wherein the first portion of the roof structure is a finished load bearing support system that is positioned over the vertical support core, and wherein the second portion of the roof structure is a finished load bearing support system that is positioned beyond peripheral limits of the vertical support core, wherein the second portion is assembled at the ground elevation, and wherein the second portion is lifted vertically relative to the vertical support core into a final position; and a plurality of floor plates, wherein each of the floorplates corresponds to a story of the multi-story building or the roof structure, and wherein each of the floorplates is assembled at the ground elevation, lifted to a final elevation, and attached to the vertical support core in a descending order.

* * * * *